United States Patent [19]

Murphy

[11] 4,183,169

[45] Jan. 15, 1980

[54] TOY

[76] Inventor: William F. Murphy, 1209 Ridgeview Dr., Greensburg, Pa. 15601

[21] Appl. No.: 878,647

[22] Filed: Feb. 17, 1978

[51] Int. Cl.[2] ..... A63H 21/02

[52] U.S. Cl. ..... 46/100; 46/1 R

[58] Field of Search ..... 46/1 R, 60, 61, 59, 46/51, 100, 49, 216; 40/415; 273/95 AA

[56] References Cited

U.S. PATENT DOCUMENTS

| | | | |
|---|---|---|---|
| 559,536 | 5/1896 | Nesbit | 46/100 X |
| 822,198 | 5/1906 | Fahrne | 46/100 |
| 2,958,980 | 11/1960 | Baginski | 46/49 |
| 3,000,138 | 9/1961 | Tagliaferri | 46/216 X |
| 3,006,094 | 10/1961 | La Monte | 40/415 |

*Primary Examiner*—John F. Pitrelli

*Attorney, Agent, or Firm*—Sughrue, Rothwell, Mion, Zinn and Macpeak

[57] ABSTRACT

A toy has a sectional, weighted body with a longitudinal slot. A grooved pulley wheel is rotatably mounted within the body in alignment with the slot, and a cord passes through the slot and under the wheel, engaging in the groove. A hook on one end of the cord adapts it for positioning in an elevated location, so that by raising or lowering the opposite extremity of the cord, the toy gravitates toward the lower end.

4 Claims, 5 Drawing Figures

FIG 1
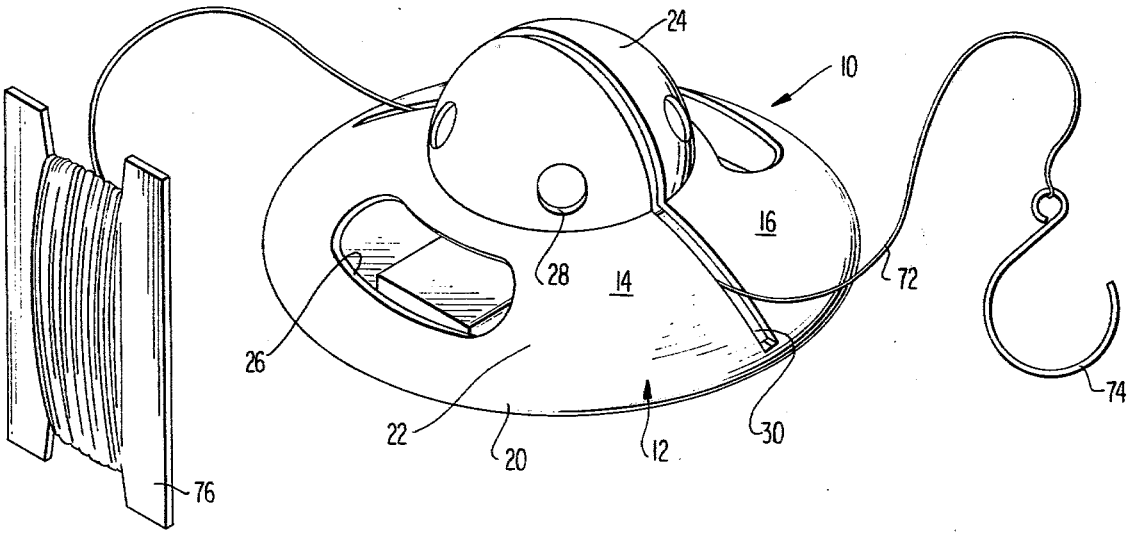
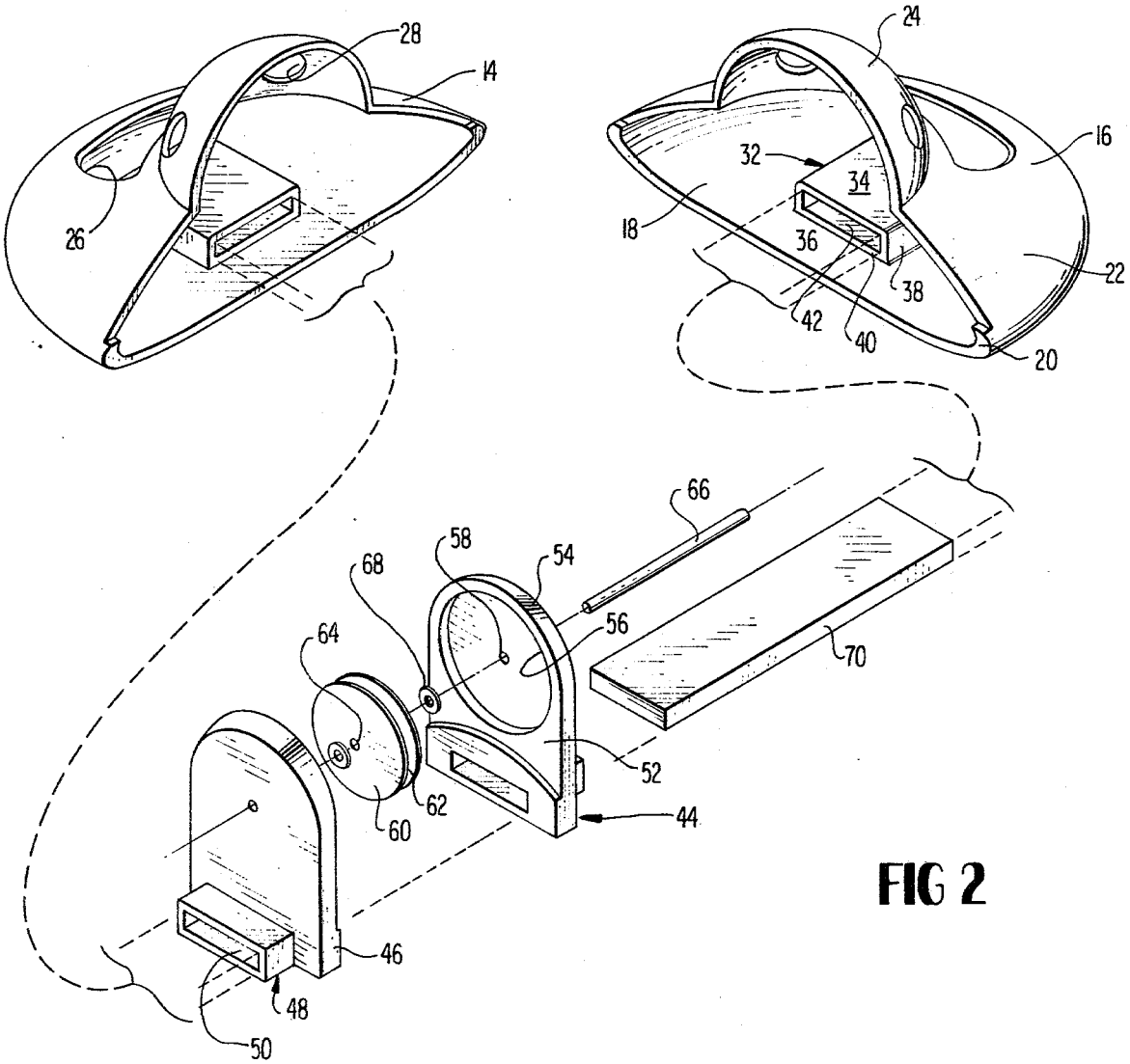
FIG 2

TOY

BACKGROUND OF THE INVENTION

1. Field of the Invention

This invention pertains to a toy employed for amusement and for the development of manipulative and perceptive skills.

2. Statement of the Prior Art

Roller toys propelled by cords or the like are heretofore known. Examples of these will be found in the below listed prior U.S. patents:

| U.S. Pat. No. | Patentee | Date of Issuance |
|---|---|---|
| 1,241,000 | Mulvey, R. J. | September 25, 1917 |
| 1,311,534 | Seymour, J. K. | July 29, 1919 |
| 2,891,351 | Madaras, E., et al | June 23, 1959 |
| 2,958,980 | Baginski, J. | November 8, 1960 |
| 3,076,287 | Jermyn, C. S. | February 5, 1963 |
| 3,728,813 | Jolliffe, J. P. | April 24, 1973 |

SUMMARY OF THE INVENTION

The present invention provides an amusement and educational toy which involves movement of an object on an elongated cord. The toy comprises a weighted body with an upper section having a slot and a wheel. The cord passes through the slot and under the wheel so that by raising and lowering the cord, the toy gravitates toward the lowermost end thereof. The cord is provided at one extremity with an attachment hook, whereby the toy may be used by one person without assistance from others.

The toy may be used competitively, as by providing one or more targets along the ground below the cord. Such utilization improves skills in depth perceptive and manipulation. In addition, a plurality of the toys may be used for races; or a single toy used in a timed contest. Longer cords also may be employed in distance tests.

An important feature of the invention is the provision of weight means in the lower body to insure that the toy remains upright on the string. The slot in the body, in addition to providing entry and exit for the cord, also maintains the position of the cord on the pulley wheel, and serves to stabilize the toy and prevent excessive swing.

Other and further objects and advantages of the invention will become apparent to those skilled in the art from a consideration of the following specification when read in connection with the annexed drawings.

BRIEF DESCRIPTION OF THE DRAWINGS

FIG. 1 is a perspective view showing a toy constructed and assembled in accordance with the teachings of this invention;

FIG. 2 is a disassembled view of the toy hereof;

DESCRIPTION OF THE PREFERRED EMBODIMENT

Figure 3:
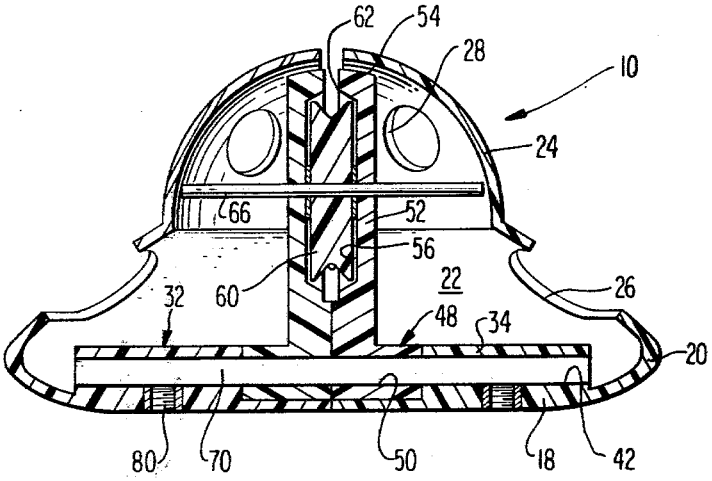
FIG. 3 is a medial cross sectional view thereof.
Figure 4:
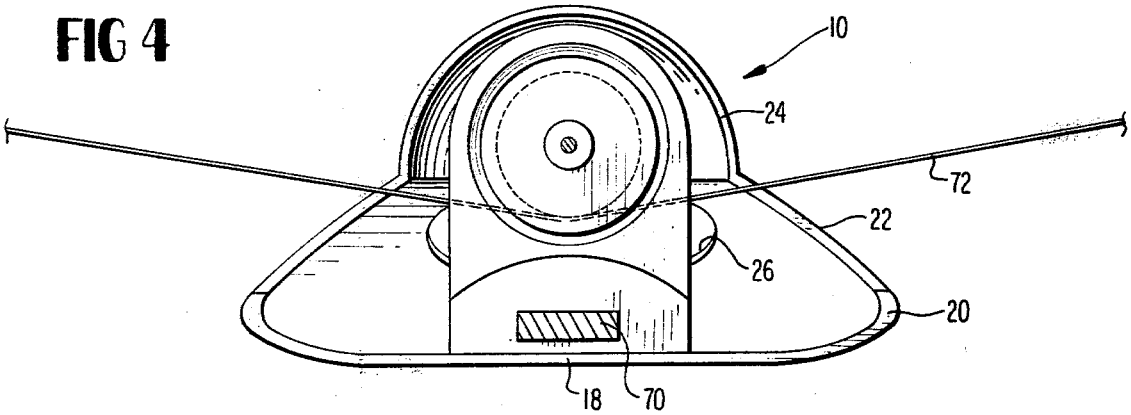
FIG. 4 is a side elevational view partially in cross section.

Referring to the drawing in more detail, a toy according to this invention is generally identified therein by reference character 10. The toy 10 comprises a body housing 12 of sectional construction including a first half 14 and a second half 16 each of identical, mating configuration and construction. The body sections 14 and 16, when assembled, make up the housing 12, described hereinafter in its assembled condition. The housing 12 may be formed of any suitable materials such as molded plastic, metal, or the like.

The housing 12 includes a bottom wall 18 of disc form having a surrounding, upwardly curving rim 20. The rim integrally joins a slat side wall 22, and this in turn is integrally connected to an upper dome 24. Both the slant wall 22 and the dome 24 have openings 26 and 28, respectively, formed therein.

The dome and slant walls have a diametric slot 30, when the halves 16 and 18 are assembled, formed by indenting the respective side edges thereof.

Fixedly secured to the bottom wall 18 within the housing are a pair of substantially rectangular sleeve members 32. Each sleeve member has a top wall 34, side walls 36, 38 and a base wall 40, the latter being molded into the bottom wall 18 when the device is formed of molded material. These walls define open chambers 42 functioning as described below.

The invention further comprises a pair of axle support members 44 also identical to one another. Each of the axle support members comprises a base portion 46 having a substantially rectangular tube portion 48. The tube portions 48 are dimensioned to coincide with the sleeves 32, and have open passageways 50 therein which are alignable with the chambers 42 of the sleeves. Extending upwardly from the base portions 46 of the axle support members are standard sections 52 which are rounded at their upper ends 54, and have round recesses 56 therein. At the center of the recesses, each has an aperture 58 therein. A pulley wheel 60 has a peripheral groove 62, and a central hole 64. The wheel is rotatably mounted on an axle 66 which extends through the apertures 58 of the axle support members, and the hole 64, and washers 68 are positioned on either side of the pulley wheel.

The weight means of the invention comprises an elongated, substantially rectangular bar 70 which is coextensive to the combined lengths of the sleeves 32 and the tube portions 48. As best seen in FIG. 3, assembly of the unit involves the frictional engagement of the bar 70 in one of the chambers 42 of one of the sleeves 32. Thereafter, the first of the axle support members is engaged on the bar, followed by the axle, the pulley wheel and washers and the second axle support member. The other sleeve is then engaged over the bar completing the assembly.

Figure 5:
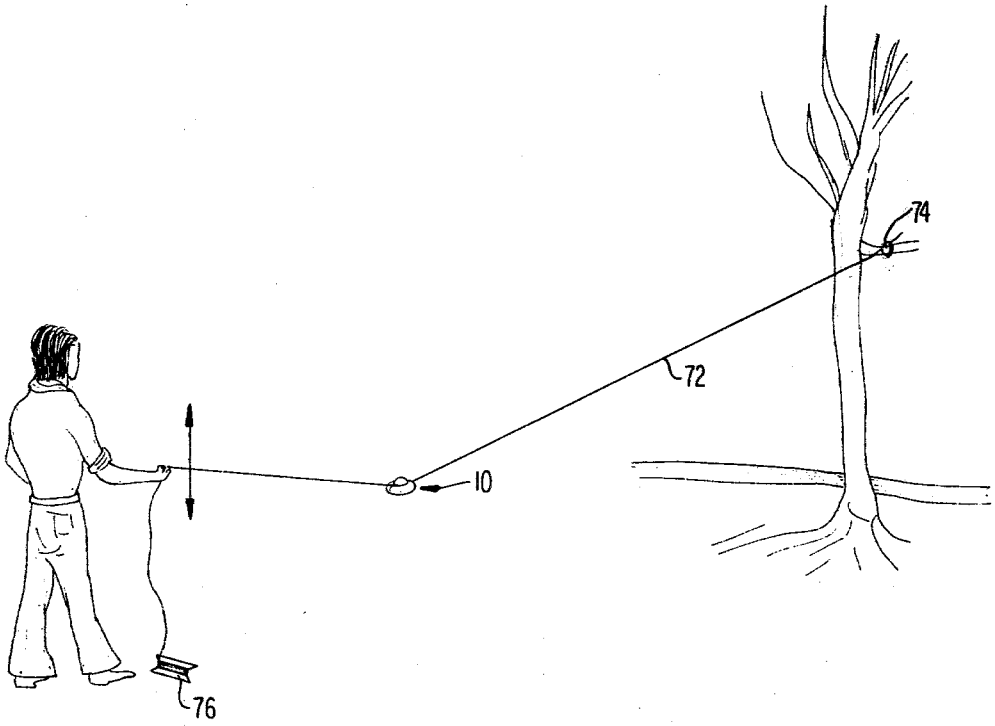
FIG. 5 illustrates a typical utilization of the toy.

An elongated cord 72 extends through the slot 30 and under the pulley wheel 60, riding in the groove 62 thereof. At one extremity, the cord may have a hook 74, while at its other end a line storage reel 76 is provided. This permits utilization in the manner shown in FIG. 5 of the drawing. It will there be observed that the hook is engaged on a tree branch at a selected height. The user may then cause the item to gravitate back and fourth on the cord by raising or lowering the end of the cord remote from the hook. The speed of travel is controlled by the angle of inclination of the cord, and may be slowed or stopped by placing the cord in horizontal position. The slot ends serve as a brake when contacted by the cord (or a supplemental rod can be provided for this purpose). Also, as indicated above, target areas may be provided on the ground beneath the cord, and the user then attempts to ground the toy on the target.

As shown in FIG. 3, said screws 80 may be employed to lock the weight member in place when desirable.

I claim:

1. A toy comprising:

a body housing having an upper body section and a bottom wall;

a pair of sleeve members fixedly secured on said wall in lateral spaced apart relationship;

a pair of upright axle support members each having a base and an opening therein;

weight means comprising an elongated weight member engaged in said sleeve members, and extending through said upright axle support member opening;

an axle spanning the axle support members and a pulley wheel rotatably mounted on said support members;

said upper body section having a longitudinally extending slot formed therein, said pulley wheel being in alignment with said slot; and an elongated cord member entering through said slot and under the wheel, whereby the wheel will ride thereon.

2. A toy comprising:

a sectional body housing of hollow form, including a bottom wall, an upper rim, and a dome, the bottom wall being of saucer form;

the dome and upper rim having a diametric slot formed therein, and the bottom wall being separable along a line coextensive with the slot;

a pair of substantially rectangular sleeve members fixedly secured to the bottom wall in spaced relation on either side of said line;

a pair of axle support members, each including a base having substantially rectangular tube thereon, and a standard section with a recess therein;

an elongated substantially rectangular weight member, the weight member being frictionally engaged in the sleeves, with the tubes frictionally engaged between the sleeves and the recesses of the standards facing one another;

an axle spanning the axle support members at the centers of the recesses;

a pulley wheel rotatably mounted on the axle for rotation in the recesses, the pulley wheel having a peripheral groove therein; and an elongated cord extended through the slot below the pulley wheel and engaged in the groove of said wheel.

3. The invention of claim 2, wherein:

said cord has a hook at one extremity thereof.

4. The invention of claim 2, and:

screw means extending through said bottom wall to engage the weight member and to lock it in place.

* * * * *